US005183642A

United States Patent [19]

Lenglet

[11] Patent Number: 5,183,642

[45] Date of Patent: Feb. 2, 1993

[54] INSTALLATION FOR STEAM CRACKING HYDROCARBONS, WITH SOLID EROSIVE PARTICLES BEING RECYCLED

[75] Inventor: Eric Lenglet, Marly le Roi, France

[73] Assignee: Procedes Petroliers et Petrochimiques, Marly Le Roi, France; a part interest

[21] Appl. No.: 700,196

[22] PCT Filed: Oct. 5, 1990

[86] PCT No.: PCT/FR90/00711

§ 371 Date: May 30, 1991

§ 102(e) Date: May 30, 1991

[87] PCT Pub. No.: WO91/05031

PCT Pub. Date: Apr. 18, 1991

[30] Foreign Application Priority Data

Oct. 6, 1989 [FR] France ..... 89 13070

[51] Int. Cl.[5] ..... B01J 8/08; C01G 9/36

[52] U.S. Cl. ..... 422/213; 422/200; 422/207; 422/217; 422/234; 110/216; 196/110; 196/122; 196/140; 208/130

[58] Field of Search ..... 422/206, 207, 213, 217, 422/234; 110/216; 208/130; 585/903; 196/110, 122, 140; 202/241

[56] References Cited

U.S. PATENT DOCUMENTS

| | | | |
|---|---|---|---|
| 2,483,494 | 10/1949 | Kleiber et al. . | |
| 2,985,324 | 5/1961 | Balentine | 414/217 |
| 3,215,505 | 11/1965 | Schmalfeld et al. | 422/311 |
| 3,729,105 | 4/1973 | Huebler et al. | 414/218 |
| 4,205,196 | 5/1980 | Makovec et al. | 585/701 |
| 4,245,571 | 1/1981 | Przewalski | 110/246 |
| 4,477,413 | 10/1984 | Carson | 422/62 |
| 4,655,147 | 4/1987 | Brännström et al. | 110/263 |
| 4,741,290 | 5/1988 | Krieger et al. | 122/4 D |
| 4,834,947 | 5/1989 | Cook et al. | 422/117 |
| 5,039,395 | 8/1991 | Martin et al. | 208/127 |

*Primary Examiner*—Lynn M. Kummert
*Assistant Examiner*—Christopher Y. Kim
*Attorney, Agent, or Firm*—Bell, Seltzer, Park & Gibson

[57] ABSTRACT

An installation for steam cracking hydrocarbons comprises at least one hydrocarbon cracking furnace, an indirect quench heat exchanger for the effluents leaving the furnace, direct quench means for said effluent, and means (36, 38) for injecting erosive solid particles into the installation for decoking purposes. The installation also includes a cyclone (10) placed at the outlet from the indirect quench heat exchanger to separate the solid particles from the gaseous effluent, with the solid particle outlet (14) from said cyclone being connected to storage tanks (20, 30) connected in series with isolating valves (16, 28, 34), a source (38) of gas under pressure being provided to raise the pressure in one of the tanks and to inject the solid particles into the installation.

21 Claims, 4 Drawing Sheets

INSTALLATION FOR STEAM CRACKING HYDROCARBONS, WITH SOLID EROSIVE PARTICLES BEING RECYCLED

The invention relates to an installation for steam cracking hydrocarbons, with solid erosive particles being recycled.

Proposals have already been made to decoke an installation for steam cracking hydrocarbons by means of solid erosive particles of fine grain size, which particles are injected into the feedstock of hydrocarbons to be cracked, with a centrifuging cyclone being used to separate the particles from the gaseous effluent either on leaving a cracking furnace or on leaving an indirect quench heat exchanger itself placed at the outlet from the cracking furnace. The level of the solid particles recovered in this way is then raised so that the particles can be reinjected upstream from the cracking zone by means of an ejector producing a high-speed flow of gas. It may therefore happen that the solid particles give rise to relatively rapid and significant erosion of the recycling means, requiring specially designed equipment to be used (having anti-abrasion coatings) which is expensive and may nevertheless have a short lifetime.

A particular object of the invention is to avoid this drawback and to enable solid particles to be recycled using means of ordinary design or of long lifetime.

Another object of the invention is to make it easy to regulate the flow rate of recycled solid particles through the steam-cracking installation, thereby ensuring high reliability of the decoking means with respect to the integrity of the equipment.

Another object of the invention is to prevent traces of liquid causing the solid particles to stick together when being separated or recycled.

To this end, the present invention provides a hydrocarbon steam cracking installation comprising at least one furnace for cracking hydrocarbons, an indirect quench heat exchanger for the effluent leaving the furnace, and direct quench means for the effluent, together with means for injecting a low flow rate of solid particles into the furnace and means, such as a cyclone for separating solid particles from the gaseous steam-cracking effluent, which means are placed between the indirect quench heat exchanger and the direct quench means, the installation being characterized in that it includes a tank for storing solid particles, with the inlet of the tank being connected to the solid outlet from the cyclone and with the outlet of the tank being connected to a particle injection duct for injecting particles into the installation, isolation means such as valves for isolating the tank, and a source of gas under pressure connected to the particle injection duct and to the tank by means such as a valve for increasing the inside pressure of the tank to a value that is not less than the pressure at the point at which particles are injected into the furnace.

The solid particles are thus injected discontinuously into the furnace while it is in operation. The above-mentioned tank serves to store the solid particles during the non-decoking stages during which particles are not injected. Thereafter, because the static pressure inside the tank can be increased, the solid particles are easily raised to a sufficient pressure and recycled in the form of a solid suspension in a dilute phase to the point where they are injected into the steam-cracking installation and without it being necessary to use a very high speed flow of vector gas. This greatly reduces the erosion of the means for recycling the solid particles.

In addition, the source of gas under pressure providing the vector gas flow also serves to increase the pressure inside the solid particle storage tank. Because of the pressure equilibrium obtained in this way, excess pressures that could compact the solid particles or that could cause the particles to be ejected too suddenly from the tank are avoided.

According to another characteristic of the invention, the installation includes an intermediate tank connected between the outlet from the cyclone and the inlet to the first-mentioned tank, and isolation means such as valves for isolating said intermediate tank.

This intermediate tank serves to store the solid particles leaving the cyclone while particles taken from the first-mentioned tank are being injected into the installation.

According to another characteristic of the invention, the installation includes a bypass pipe connected as a bypass round the indirect quench heat exchanger between the outlet from the cracking furnace and the above-mentioned cyclone for the purpose of taking off a small fraction of the effluent flow leaving the furnace and for drying the solid particles by direct contact with said taken-off fraction, at a temperature corresponding to substantially total absence of any liquid on the solid particles.

The cracked gases leaving the indirect quench heat exchanger are generally at a temperature lying in the range 350° C. to 600° C., thereby limiting secondary reactions while being sufficiently high to ensure that the gases contain substantially no liquid. Nevertheless, when the feedstock to be steam cracked is heavy (e.g. heavy naphtha or gas oil) it may happen that these gases contain a mist of very heavy hydrocarbons, or of tars, or of "liquid" coke.

The invention makes it possible to vaporize or carbonize a major part of these liquid traces without having recourse to conventional means consisting in burning these liquids in the presence of oxygen, which is very difficult to achieve from the safety point of view.

For vaporizing or carbonizing the traces of liquid, as the case may be, the temperature of the solid particles leaving the indirect quench heat exchanger is increased by an amount in the range about 30° C. to about 250° C.

The steam-cracking installation can therefore be used with relatively heavy feedstock that gives rise to traces of condensed hydrocarbons at the outlet from the indirect quench heat exchanger, without it being necessary to impose too high a temperature on a permanent basis at the outlet from said indirect quench heat exchanger which would lead to energy losses during operation of the installation. The bypass need only be put into operation during particle injection periods.

This simple method of drying the solid particles also prevents them sticking together on being separated in the cyclone or while being recycled via the above-mentioned tanks.

In a first embodiment of the invention, the bypass pipe is connected to the duct connecting the indirect quench heat exchanger to the cyclone, and upstream from the cyclone (possibly directly at the outlet from the quench heat exchanger). The fraction of the effluent flow taken off at the outlet from the furnace is then mixed with the effluent flow leaving the indirect quench heat exchanger prior to the particles being separated in the cyclone.

In a variant, the bypass pipe is connected to the solid outlet duct from the cyclone and leads to a secondary cyclone at a high temperature which is sufficient to ensure that traces of liquid present on the solid particles are vaporized and/or carbonized.

In this case, the solid particles leaving the main cyclone are entrained by a small flow rate of gaseous effluent, thereby preventing them sticking together prior to being superheated by coming into contact with the above-mentioned fraction taken from the flow of gaseous effluent leaving the furnace. The secondary cyclone may be much smaller in size than the main cyclone and may operate at a higher temperature, thus making it possible either to vaporize or to carbonize the traces of liquid present on the solid particles.

These two variants may be combined.

Advantageously, the installation also includes pre-quench means for quenching said fraction taken off from the effluent flow, said means being provided in the vicinity of the upstream end of said pipe and comprising, for example, means for injecting dilution vapor (where the term "vapor" includes steam).

Pre-quenching may consist in cooling the effluent leaving the furnace and taken off in the bypass by any amount lying in the range 70° C. to 200° C. (by direct contact with a gas).

This avoids excessive cracking of the taken-off fraction of gaseous effluent in the bypass pipe.

According to yet another characteristic of the invention, relating to an installation comprising a plurality of cracking furnaces with respective indirect quench heat exchangers disposed in parallel and connected to direct quench means for the gaseous effluent, the outlets from the indirect quench heat exchangers of the furnaces are connected to common means for separating and recycling solid particles, said common means comprising the above-mentioned cyclones and tanks.

This reduces the cost of a steam-cracking installation of the invention.

Advantageously, the outlets from the indirect quench heat exchangers are connected to the common means for separating and recycling solid particles by bypass pipes which are provided with isolating valves and which are connected to the ducts connecting said outlets to the direct quench means.

Preferably, the isolating valves of the bypass pipes remain permanently in the open position. Under such circumstances they do not provide a sealing function and may be constituted for example, by simple non-fluidtight flaps.

An installation of this type provides several significant advantages:

the various steam-cracking furnaces may be decoked sequentially without it being necessary to use large diameter isolating valves specifically designed to pass a gas carrying erosive particles, which valves are extremely expensive;

the bypass pipes converging the gaseous effluents carrying solid particles are never connected to the atmosphere nor are they connected to a source of gas containing oxygen, and this constitutes an important safety factor;

the general reliability of the installation is greatly increased since the above-mentioned isolating valves remain in the open position and, in principle, they do not move during normal operation of the installation, unlike prior methods in which the decoking circuit is totally isolated; and solid particles can be separated from the gaseous effluent with extremely high efficiency and at low cost, thereby avoiding any risk of polluting the direct quench means or the environment.

BRIEF DESCRIPTION OF THE DRAWINGS

The invention will be better understood and other characteristics, details, and advantages thereof will appear more clearly on reading the following description made by way of example and with reference to the accompanying drawings, in which.

Figure 1:
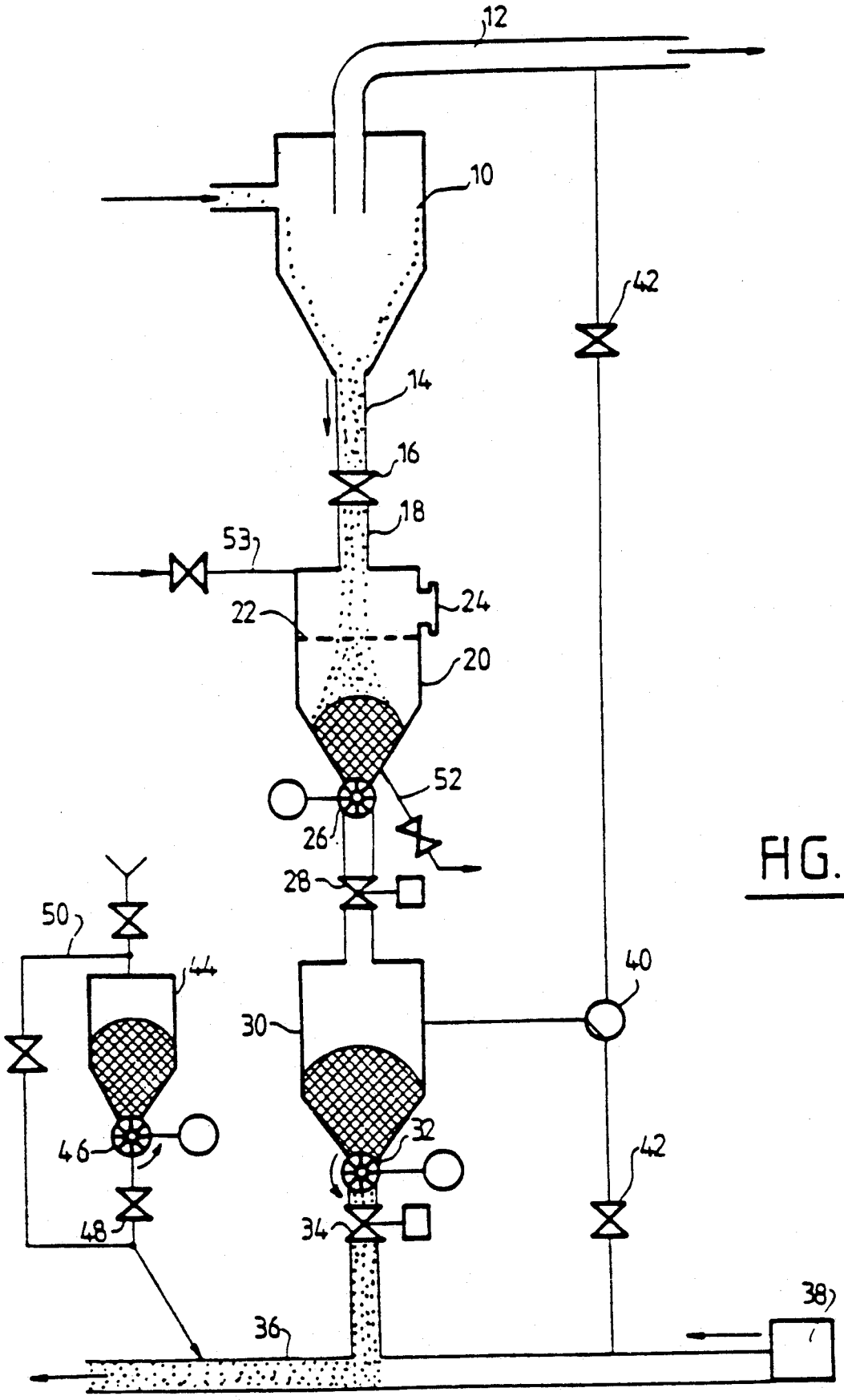
FIG. 1 is a diagram of a portion of solid particle recycling means of the invention in first state.
Figure 2:
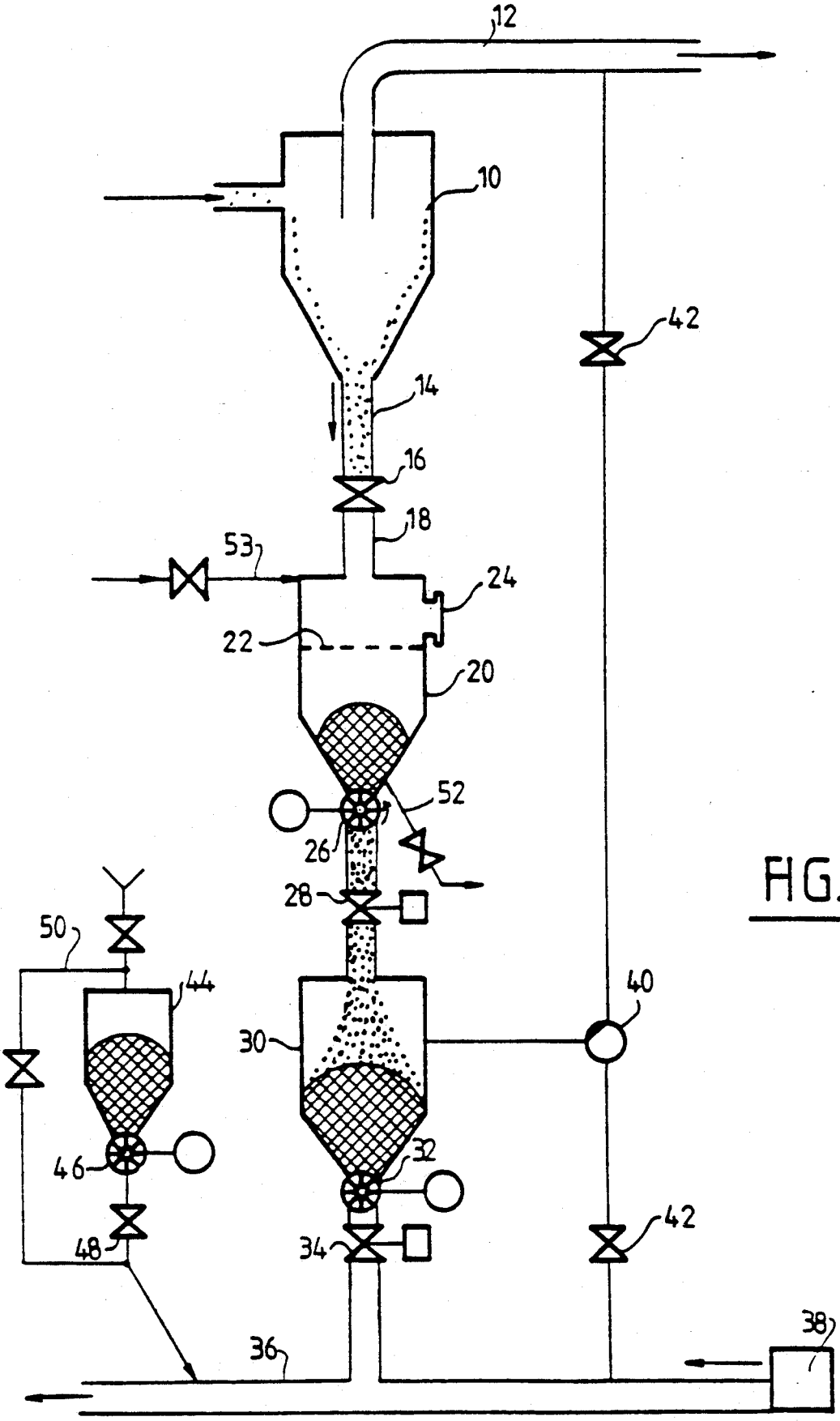
FIG. 2 shows said means in another state.

Reference is made initially to FIGS. 1 and 2 which show a portion of solid particle recycling means of the invention by way of example.

These means comprise a cyclone 10 which is fed from a heat heat exchanger performing indirect quenching on the gaseous effluent leaving a hydrocarbon steam-cracking furnace, with the top of the cyclone including an outlet 12 for gaseous effluent leading to direct quench means, and with the bottom of the cyclone including an outlet 14 for the solid particles separated inside the cyclone 10 from the gaseous effluent. The outlet 14 is connected via an isolating valve 16 to the top inlet 18 of a tank 20 containing means 22 such as a screen for separating out and retaining large solid particles, and an orifice 24 for removing such particles.

The bottom portion of the tank 20 in which the fine solid particles collect is connected via a motor-driven rotating member 26 of the rotary air lock type or of the rotary screw type, and via an isolating valve 28 to the inlet of another tank 30 whose bottom outlet includes a motor-driven rotary member 32 and an isolating valve 34 identical to the above-mentioned member 26 and valve 28.

Downstream from the valve 34, the outlet from the tank 30 is connected to a duct 36 for recycling the solid particles into the steam-cracking installation. A source 38 of gas under pressure feeds the duct 36 with gas flowing at medium speed or at a relatively low speed.

A three-port valve 40 serves to connect the tank 30 either to the source of gas under pressure 38, or else to the gas outlet duct 12 from the cyclone. Stop valves 42 are provided in the ducts connecting the valve 40 respectively to the source of gas under pressure 38 and to the duct 12.

An independent tank 44 filled with solid particles of determined mean grain size serves to inject a topping-up quantity of solid particles into the recycling duct 36 via a motor-driven rotary member 46 and an isolating valve 48. For this purpose, the top portion of the tank 44 is connected to the output from said tank by a pressure-equalizing duct 50.

The rotary member 46 serves to keep the flow rate of topping-up particles regular.

The bottom of the tank 20 may be provided with a purge duct 52 for drawing off a certain quantity of solid particles. A barrier gas inlet duct 53 opens out into the top portion of the tank 20. The barrier gas is free from heavy aromatics and it may be steam. It serves to prevent the tank 20 and the screen 22 from coking.

These recycling means operate as follows:

Assume initially that the valve 16 upstream from the tank 20 is open, that the outlet member 26 from this tank is not rotating, and that the isolating valve 28 is closed. Under these conditions, the solid particles leaving the cyclone 10 collect in the tank 20 after being filtered by the screen 22 which serves to retain larger-sized particles. The barrier gas delivered by the duct 53 prevents heavy aromatics entering the tank.

During this stage, the bottom tank 30 which has previously been filled with solid particles coming from the top tank 20 is progressively emptied of its solid particles which are injected into the duct 36. To do this, the isolating valve 34 downstream from this tank is open, the rotary member 32 is caused to rotate, and the inside volume of the tank 30 is connected to the source of gas under pressure 38 via the valve 40, with the corresponding stop valve 42 being open. The gas delivered by the source 38 is at a pressure that is at least equal to or is slightly greater than the pressure at the point where the solid particles are injected into the steam-cracking installation, which pressure is greater than the pressure in the outlet duct 12 from the cyclone 10.

The pressure inside the tank 30 is therefore higher than the pressure inside the upper tank 20 and it is in equilibrium with the pressure in the recycling duct 36. The source 38 delivers gas into said duct at a relatively low speed lying in the range 5 meters per second (m/s) to 25 m/s, e.g. in the range 10 m/s to 20 m/s, thereby enabling the solid particles to be transported in a dilute suspension at least as far as the point where they are injected into the steam-cracking installation. The low speed of the carrier gas flow prevents significant erosion of the recycling duct.

When the tank 30 is empty or substantially empty, the rotary member 32 is no longer driven, the isolating valve 34 is closed, and the tank 30 is connected to the outlet duct 12 from the cyclone via the valve 40. The tank 30 is then at the same pressure as the upper tank 20, and the solid particles contained in the tank 20 can then be transferred into the tank 30 merely by opening the isolating valve 28 and driving the rotary member 26.

Thereafter, drive is removed from the rotary member 26, the isolating valve 28 is closed again, the tank 30 is connected to the source of gas under pressure 38, drive is applied to the rotary member 32, and the valve 34 is opened, thereby injecting solid particles again into the steam-cracking installation.

In a variant, in order to transfer the particles from the tank 20 into the tank 30, it is possible to equalize the pressures in these two tanks at the pressure of the gas source 38 rather than at the pressure of the cyclone 10, this being done by isolating the tank 20 and then connecting it to the gas source 38.

Whenever necessary, the purge duct 52 is used to withdraw excess solid particles from the tank 20, which excess is constituted by a mixture of abrasive particles coming from the topping-up tank and particles of coke detached from the inside walls of the steam cracking installation. By purging the tank 20 regularly, accumulation of medium-sized solid particles in the flow of particles recycled through the installation is avoided, and the concentration of coke in the particles is reduced. The topping-up tank 44 serves to add a desired quantity of solid particles of desired grain size into the flow of recycled particles.

The motor-driven rotary members interposed between the outputs of the tanks and their downstream isolating valves serve to regulate the flow rate of solid particles leaving the tanks and to prevent the downstream valves becoming obstructed or clogged.

In a variant, as already described in the Applicants' international patent application PCT/FR90/00272, the tanks 20 and 30 could be disposed in parallel instead of being in series.

Figure 3:
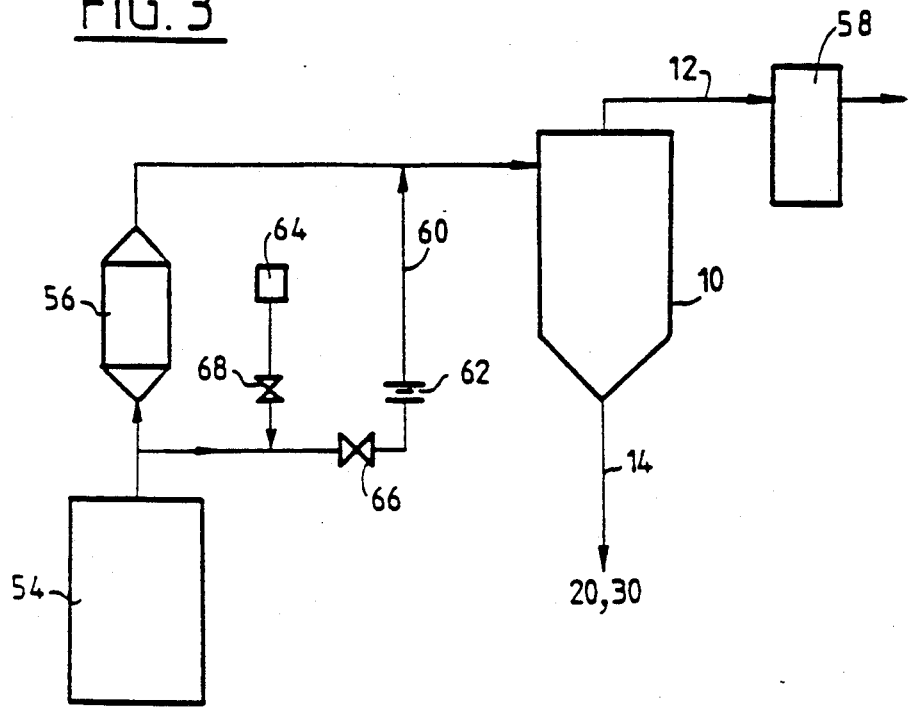
FIG. 3 shows a steam-cracking installation of the invention enabling solid particles to be dried.

Reference is now made to FIG. 3 which is a diagram showing means for drying the solid particles used for decoking the installation.

The installation comprises a steam-cracking furnace given an overall reference 54 and having its gaseous effluent outlet connected to the inlet of an indirect quench heat exchanger 56. The outlet from the heat exchanger is connected to the inlet of the cyclone 10 whose gas outlet 12 is connected to means 58 for directly quenching the gaseous effluent and whose solid outlet 14 is connected to the above-described means 20 and 30 for storing solid particles.

It may happen, particularly when the feedstock to be cracked is relatively heavy, that the gaseous effluent leaving the indirect quench heat exchanger 56 contains traces of liquid such as condensed hydrocarbons. These traces of liquid are deposited on the solid particles and there is a risk of the particles sticking together.

To avoid this drawback, the invention provides for a bypass pipe 60 having its upstream end connected to the outlet duct from the furnace 54 upstream from the direct quench heat exchanger 56, and having its downstream end connected to the outlet duct from the direct quench heat exchanger 56 upstream from the inlet to the cyclone. This bypass pipe 60 includes a calibrated orifice 62 for taking off only a small fraction of the gas effluent flow leaving the furnace 54.

In order to prevent any excess cracking of the effluent in the pipe 60 which may be relatively long, indirect quench means 64 are provided close to its upstream end, e.g. means for injecting a certain quantity of diluting steam. Thus, for example, the gas effluent leaving the furnace 54 at a temperature of about 850° C. is cooled down to about 700° C. in the pipe 60. The gas leaving the indirect quench heat exchanger 56 may be at a temperature of about 400° C., for example, and is therefore reheated by coming into direct contact with the gaseous effluent conveyed by the bypass pipe 60, e.g. to a temperature of about 480° C. This temperature increase should be sufficient to vaporize any traces of liquid present in the gaseous effluent flow entering the cyclone 10.

Naturally, it is only in periods during which the furnace 54 is being decoked by means of solid erosive particles that there is any point in taking off a small fraction of the flow of gaseous effluent from the outlet of the furnace 54. At other times, a stop valve 66 provided in the bypass pipe 60 serves to prevent the gas being taken off. The pre-quench means 64 are also provided with an isolating valve 68.

Figure 4:
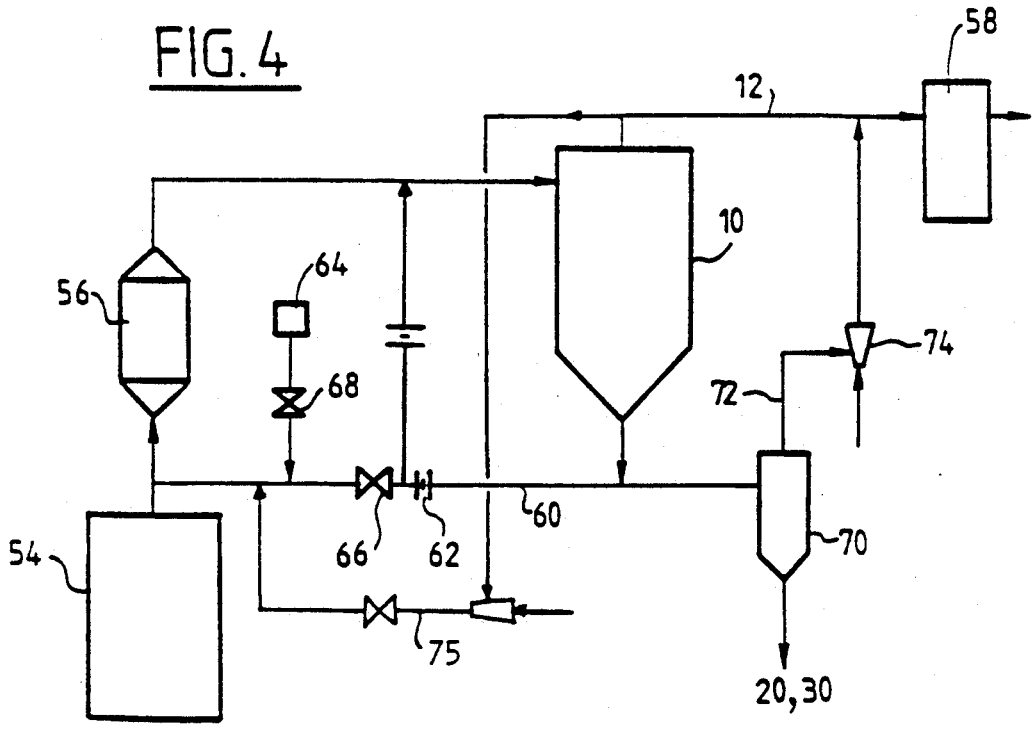
FIG. 4 shows a variant embodiment of said installation.

FIG. 4 shows a variant embodiment of the means for drying the solid particles. In this variant, the bypass pipe 60 is connected to the particle outlet 14 from the cyclone 10 and leads to the inlet of an auxilary cyclone 70 of considerably smaller dimensions than the above-mentioned cyclone 10. The gas outlet 72 from the cyclone 70 is connected to the inlet of the direct quench means 58 via an ejector 74 or similar means. The particle outlet from the auxiliary cyclone 70 leads to the above-mentioned storage tanks 20 and 30. This variant operates as follows.

In periods during which the furnace 54 is being decoked, a small fraction of the gaseous effluent flow rate leaving the furnace 54 is taken off by the bypass pipe 60 and is mixed with a small flow rate of gaseous effluent leaving the main cyclone 10 together with the solid particles, and the mixture is injected into the auxiliary cyclone 70.

Even if the gaseous effluent flow leaving the indirect quench heat exchanger 56 contains traces of condensed hydrocarbons that are deposited on the solid particles, these particles are entrained in the outlet duct 14 from the cyclone 10 by the small gaseous effluent flow rate and they do not agglomerate inside the cyclone or in the outlet duct 14. These solid particles are reheated by direct contact with the gaseous effluent provided by the bypass pipe 60 prior to being injected into the auxiliary cyclone 70. The temperature in this cyclone is high enough (e.g. in the range about 500° C. to about 730° C.) for the traces of liquid carried by the solid particles to be vaporized and/or carbonized.

The hot gases leaving the cyclone 70 are conveyed via the ejector 74 to the direct quench means 58.

The valve 66 in FIGS. 3 and 4 must be designed to operate at high temperature and to withstand the erosive particles that pass through it. This type of valve is expensive. It may be omitted by connecting a barrier gas feed duct 75 to the pipe 60 upstream from the calibrated orifices 62. The relatively cold barrier gas prevents effluent at the outlet from the furnace being taken off except during decoking periods. Such a barrier gas may be taken from the outlet 12 of the cyclone 10 and recompressed, e.g. by means of an ejector, as shown in the drawing.

The barrier gas may also serve to pre-quench the taken-off gaseous effluent during decoking periods. Under such conditions, the means 64, 68 may be omitted.

Finally, as shown in FIG. 4, the embodiments of FIGS. 3 and 4 may be combined.

Figure 5:
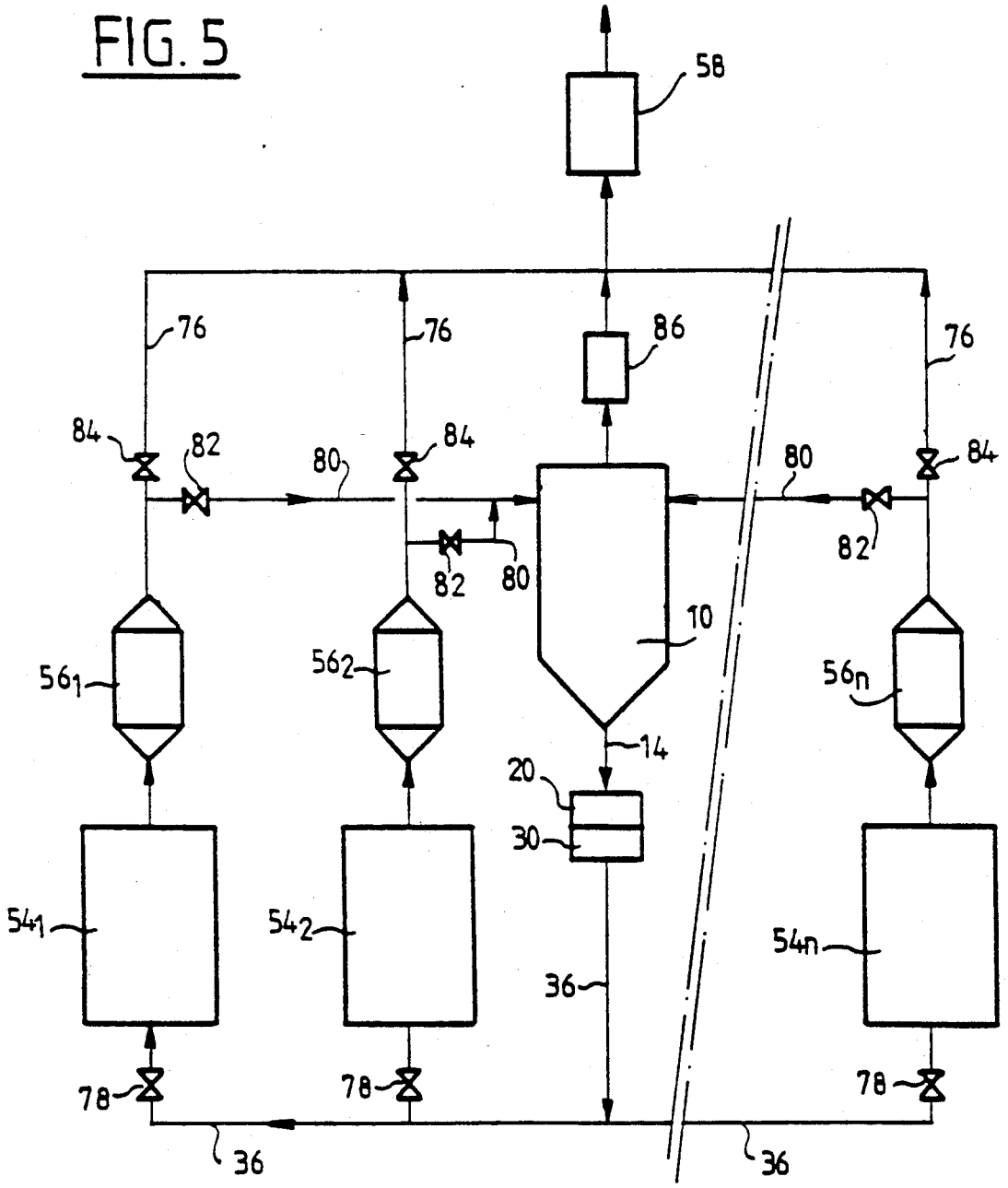
FIG. 5 shows a steam-cracking installation of the invention, of the type comprising a plurality of steam-cracking furnaces disposed in parallel.

Reference is now made to FIG. 5 which is a diagram of a steam-cracking installation of the invention comprising a plurality of cracking furnaces disposed in parallel.

These cracking furnaces designated by references $54_1, 54_2, \ldots, 54_n$ are associated with respective indirect quench heat exchangers $56_1, 56_2, \ldots, 56_n$ whose outlets are connected by ducts 76 to the means 58 for direct quenching of the gaseous effluent.

This installation is of the type in which the cracking furnaces are decoked sequentially, and it includes solid particle injecting ducts 36 connecting the above-mentioned storage means 20, 30 to the particle injection points of the furnaces 54, with each of these ducts 36 including a small-sized stop valve 78 immediately upstream from the injection point into each furnace 54. The outlets from the indirect quench heat exchangers 56 are also connected via bypass pipes 80 including isolating valves 82 to common solid particle separation means including at least one cyclone 10 of the above-mentioned type. The solid outlet 14 from the cyclone is connected to the above-mentioned storage means 20, 30 and the gas outlet 12 from the cyclone is connected with the ducts 76 to the inlet of the direct quench means 58. In addition, the ducts 76 include isolating valves 84 provided downstream from the connections to the bypass pipes 80.

This installation may be used as follows:

When one of the cracking furnaces is to be decoked, e.g. the furnace $54_1$, the isolating valve 84 in its duct 76 is closed and the valve 82 in the corresponding bypass pipe 80 is opened. Solid particles are injected into the furnace $54_1$ by opening the corresponding stop valve 78. The valves 84 in the ducts 76 of the other furnaces are open, and the valves 82 of the bypass pipes 80 of the other furnaces are closed, such that the flow of gaseous effluent and solid particles leaving the furnace $54_1$ passes through the cyclone 10 while the flows of gaseous effluent leaving the other furnaces pass directly to the direct quench means 58. Once furnace $54_1$ has been decoked, the corresponding valve 78 is closed, the valve 84 associated with this furnace is opened and the valve 82 associated therewith is closed, then the operations described above for decoking the furnace $54_1$ are repeated for the furnace $54_2$.

As a result, the valves 82 in the bypass pipes 80 are operated relatively frequently. In addition, these valves are extremely expensive since they are designed to pass large flows of gas conveying erosive particles.

It is therefore preferable to operate the installation as follows:

All of the valves 82 are left open permanently. When it is desired to decoke one of the furnaces, e.g. the furnace $54_1$, the associated valve 84 is closed and erosive solid particles are injected into the furnace by opening the corresponding valve 78. The valves 84 associated with the other furnaces are open, as are the valves 82 in the corresponding bypass pipes. As a result, the total gaseous effluent flow conveying erosive solid particles and leaving the furnace $56_1$ is delivered to the cyclone 10 together with a fraction of the gaseous flows that are not conveying solid particles coming from the other furnaces $56_2, \ldots, 56_n$. The remaining fractions of the gaseous effluent flows leaving these other furnaces are conveyed directly to the direct quench means 58. Solid particle separation in the cyclone 10 is excellent and is little affected by the gaseous effluent that is conveying the solid particles being diluted by the gaseous effluent that is not conveying solid particles.

Naturally, the cyclone must be dimensioned suitably to be able to accept such a higher flow of gaseous effluent. However, this over-dimensioning is more than compensated by the fact that the valves 82 remain permanently in the open position. As a result, it is possible to use valves that are much cheaper than in the preceding case, e.g. non-fluidtight means such as flaps, and serving to control the flows of gaseous effluent that pass along the pipes 80 during decoking periods and outside decoking periods.

It may also be observed, in this case, that all of the bypass pipes 80 convey a flow of gaseous effluent on a permanent basis. They therefore remain at constant temperature, thereby avoiding cooling, cold points, particle sticking, etc. In addition, these bypass pipes 80 are never connected to the atmosphere or to a source of gas containing oxygen, and this constitutes a significant safety factor.

In order to enable the cyclone 10 to accept a large gas flow and then direct it to the direct quench means 58, it is advantageous to keep the cyclone 10 at a pressure lower than the pressure of the gaseous effluent at the outlet from the indirect quench heat exchangers 56. To do this, it is possible to use an ejector 86 as shown diagrammatically in FIG. 5, or means for putting the cyclone into communication with a network at lower pressure, or by any other suitable analogous means.

The invention is also applicable to sequentially decoking different passes through a single furnace leading to indirect quench heat exchangers whose outlets are connected by bypasses to common means for separating and recycling solid particles.

I claim:

1. A hydrocarbon steam cracking installation comprising at least one furnace for cracking hydrocarbons, an indirect quench heat exchanger connected to said furnace for receiving effluent leaving the furnace, direct quench means, an effluent duct connecting said indirect quench heat exchanger to said direct quench means, a particle injection duct cooperating with said at least one furnace for injecting solid particles into said furnace, a separator connected between said indirect quench heat exchanger and said direct quench means for separating solid particles from the gaseous effluent passing from said indirect quench heat exchanger to said direct quench means, said separator including a solids outlet for discharge of solid particles collected by the separator, a tank for storing solid particles, said tank having an inlet connected to said solids outlet of said separator and having an outlet connected to said particle injection duct whereby solid particles may be introduced into said duct, a source of gas under pressure connected to said particle injection duct, and a conduit also connecting said source of gas under pressure to said tank for increasing the inside pressure of said tank to a value that is not less than the pressure in said particle injection duct.

2. An installation according to claim 1, further comprising an intermediate tank connected between the outlet from said separator and the inlet to said first mentioned tank, and isolation means connected to an outlet of said first mentioned tank for isolating said intermediate tank from said first mentioned tank.

3. An installation according to claim 2, wherein said intermediate tank further comprises means for retaining solid particles greater than a predetermined size.

4. An installation according to claim 3, including means for injecting a barrier gas free from heavy aromatics into said intermediate tank.

5. An installation according to claim 1, further comprising bypass pipe having one end connected between the outlet from said furnace and said separator to take off a fraction of the effluent flow leaving said furnace for drying solid particles by direct contact with said taken-off fraction.

6. An installation according to claim 5, wherein the opposite end of said bypass pipe is connected between said indirect quench heat exchanger and said separator so that the taken-off fraction of the effluent flow leaving said furnace bypasses said indirect quench heat exchanger.

7. An installation according to claim 5, further comprising a secondary separator, and wherein the opposite end of said bypass pipe is connected to the solids outlet duct from said separator and leads to said secondary separator, the secondary separator thus receiving the high temperature taken-off fraction of the effluent flow leaving said furnace to ensure that traces of liquid present on the solid particles are vaporized and/or carbonized.

8. An installation according to claim 7 including an ejector, and a duct connecting the gas outlet of said secondary separator via said ejector to the effluent duct connecting said first-mentioned separator to said direct quench means.

9. An installation according to claim 5 further comprising pre-quench means cooperating with said bypass pipe for quenching said fraction taken off from the effluent flow.

10. An installation according to claim 5 further comprising a feed duct for feeding a relatively cold barrier gas to said bypass pipe to oppose gaseous effluent being taken off from the outlet of the furnace by said bypass pipe other than during decoking periods, and/or to pre-quench said effluent during decoking periods.

11. An installation according to claim 1 further comprising a plurality of said furnaces, each with an associated indirect quench heat exchanger, said furnaces and their associated indirect quench heat exchangers being disposed in parallel and connected to said direct quench means, and the outlets from each indirect quench heat exchanger being commonly connected to said separator and to said tank.

12. An installation according to claim 11 wherein the outlets from the indirect quench heat exchangers are commonly connected to said separator by respective bypass pipes, each provided with an isolating valve.

13. An installation according to claim 12 wherein said isolating valves are permanently in the open position.

14. An installation according to claim 11 wherein the gas outlet from the separator is connected to said direct quench means via an ejector for ensuring that the pressure in the separator is lower than the pressure of the effluent at the outlets from the indirect quench heat exchangers.

15. A hydrocarbon steam cracking installation comprising a plurality of furnaces disposed in parallel for cracking hydrocarbons introduced therein, an indirect quench heat exchanger connected to each respective furnace for cooling gaseous effluent leaving the furnace, direct quench means, respective effluent ducts connecting each of said indirect quench heat exchangers to said direct quench means, a particle injection duct cooperating with each said furnace for injecting solid particles into the respective furnaces, and common means for separating the solid particles from the effluents and for recycling the particles into said furnaces, said common means for separating and recycling comprising at least one cyclone separator, said separator including a solids outlet for discharge of solid particles collected by the separator, a tank for storing solid particles, said tank having an inlet connected to said solids outlet of said cyclone separator and having an outlet connected to said particle injection duct whereby solid particles may be introduced into said duct, a source of gas under pressure connected to said particle injection duct, and a conduit also connecting said source of gas under pressure to said tank for increasing the inside pressure of said tank to a value that is not less than the pressure in said particle injection duct, each furnace having a solid particles injection valve associated with said particle injection duct for individually controlling the flow of solid particles into the furnace, each furnace also having an isolating valve provided in the respective effluent duct connecting the indirect quench heat exchanger to said direct quench means, and each furnace also having a second duct connected to said effluent duct upstream from said isolating valve and connected to the common separation and recycle means, the isolating valve of a furnace being closed when the corresponding injection valve for that furnace is opened in order to direct the mixture of gaseous effluents and solid particles to said common separation and recycle means.

16. An installation according to claim 15 further comprising a second isolating valve provided in each said second duct, said second isolating valve being permanently in the open position in order to direct a fraction of gaseous effluents towards said cyclone separator.

17. An installation according to claim 15 wherein said common means for separating and recycling the solid particles further comprises a gas effluent outlet is connected to said direct quench means via an ejector for ensuring that the pressure in the separator is lower than the pressure of the effluent at the outlets from the indirect quench heat exchangers.

18. An installation according to claim 15, wherein said common means for separating and recycling further comprises an intermediate tank connected between the outlet from said cyclone separator and the inlet to said first mentioned tank, and isolation means for isolating said intermediate tank from said first mentioned tank.

19. An installation according to claim 18, wherein said intermediate tank further comprises means for retaining solid particles greater than a predetermined size.

20. An installation according to claim 19, further comprising means for injecting a barrier gas free from heavy aromatics into said intermediate tank.

21. An installation according to claim 15, further comprising control means cooperating with the particle injection valves for the respective furnaces for opening a particle injection valve in one furnace while closing the particle injection valves of the other furnaces so that particles can be sequentially injected into the respective furnaces.

* * * * *

UNITED STATES PATENT AND TRADEMARK OFFICE

CERTIFICATE OF CORRECTION

PATENT NO. : 5,183,642

DATED : February 2, 1993

INVENTOR(S) : Eric Lenglet

It is certified that error appears in the above-identified patent and that said Letters Patent is hereby corrected as shown below:

On the Title Page under [56] References Cited, the following two references should be listed:

| | | |
|---|---|---|
| 1,939,112 | 12/12/33 | Eulberg |
| 4,297,147 | 10/27/81 | Nunciato et al. |

Column 9, line 42, "including" should be -- further comprising --.

Column 9, lines 45-46, after "comprising" an -- a -- should be inserted.

Column 9, line 66, "including" should be -- further comprising --.

Signed and Sealed this

Thirtieth Day of November, 1993

Bruce Lehman

*Attest:*

BRUCE LEHMAN

*Attesting Officer*

*Commissioner of Patents and Trademarks*